US010695826B2

(12) United States Patent
Breneman et al.

(10) Patent No.: US 10,695,826 B2
(45) Date of Patent: Jun. 30, 2020

(54) APPARATUS AND METHOD FOR INVESTMENT CASTING CORE MANUFACTURE

(71) Applicant: United Technologies Corporation, Farmington, CT (US)

(72) Inventors: Ryan C. Breneman, West Hartford, CT (US); Steven J. Bullied, Pomfret Center, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 8 days.

(21) Appl. No.: 15/651,594

(22) Filed: Jul. 17, 2017

(65) Prior Publication Data

US 2019/0015893 A1 Jan. 17, 2019

(51) Int. Cl.

| | |
|---|---|
| ***B22C 9/10*** | (2006.01) |
| ***B22C 9/04*** | (2006.01) |
| ***B28B 11/24*** | (2006.01) |
| ***B28B 1/24*** | (2006.01) |
| ***B22C 1/14*** | (2006.01) |
| ***B22C 1/22*** | (2006.01) |
| ***B22C 1/20*** | (2006.01) |

(52) U.S. Cl.

CPC ..... *B22C 9/10* (2013.01); *B22C 1/14* (2013.01); *B22C 1/20* (2013.01); *B22C 1/222* (2013.01); *B22C 9/04* (2013.01); *B28B 1/24* (2013.01); *B28B 11/243* (2013.01)

(58) Field of Classification Search

CPC ..... B22C 9/10; B22C 9/04

See application file for complete search history.

(56) References Cited

U.S. PATENT DOCUMENTS

| | | | | |
|---|---|---|---|---|
| 2,912,729 | A * | 11/1959 | Webb | B22C 9/04 106/38.35 |
| 3,165,799 | A * | 1/1965 | Watts | B22C 1/165 106/38.35 |
| 3,423,216 | A | 1/1969 | Somers | |
| 3,648,756 | A * | 3/1972 | McLaren | B22C 9/02 164/137 |

(Continued)

FOREIGN PATENT DOCUMENTS

| | | |
|---|---|---|
| GB | 2202541 | 9/1988 |
| JP | H02303651 | 12/1990 |

OTHER PUBLICATIONS

European Search Report dated Nov. 30, 2018 for EP Application No. 18183917.6.

*Primary Examiner* — Liam J Heincer

(74) *Attorney, Agent, or Firm* — Getz Balich LLC

(57) ABSTRACT

A method of producing an investment casting ceramic core is provided that includes: providing a core body consisting of a leachable material; surrounding the core body with a mold composition within a vessel, which mold composition is configured to solidify; leaching the core body from the mold composition subsequent to the mold composition solidifying, thereby leaving an internal cavity within the solidified mold composition; depositing a ceramic composition within the internal cavity of the solidified mold composition; sintering the ceramic composition to a solid ceramic core; and removing the solid ceramic core from the mold composition.

14 Claims, 5 Drawing Sheets

(56) References Cited

U.S. PATENT DOCUMENTS 3,835,913 A * 9/1974 Vandemark ..... B22C 7/02 164/244
4,093,017 A * 6/1978 Miller, Jr. ..... B22C 1/00 164/28
4,533,394 A * 8/1985 Watts ..... B22C 1/165 106/38.2
4,689,081 A * 8/1987 Watts ..... B22C 1/165 106/38.4
4,925,492 A * 5/1990 Kelkar ..... B22C 9/10 106/38.22
4,989,664 A * 2/1991 Roth ..... B22C 1/00 106/38.9
5,297,615 A * 3/1994 Aimone ..... B22C 9/04 164/361
5,465,780 A 11/1995 Muntner et al.
5,996,682 A * 12/1999 Cai ..... B22C 1/20 164/132
6,024,787 A * 2/2000 Lee ..... B22C 1/185 106/38.2
6,117,612 A * 9/2000 Halloran ..... G03F 7/0037 264/401
6,494,250 B1 * 12/2002 Frank ..... B22C 9/10 164/369
6,626,230 B1 * 9/2003 Woodrum ..... B22C 1/22 164/137
6,637,500 B2 * 10/2003 Shah ..... B22C 9/04 148/404
7,278,465 B1 * 10/2007 McGuire ..... B22C 9/04 164/35
8,196,640 B1 * 6/2012 Paulus ..... B22C 9/10 164/246
8,302,668 B1 * 11/2012 Bullied ..... B22C 9/103 164/516
9,162,279 B1 * 10/2015 Pickens ..... B22C 7/02
9,186,640 B2 11/2015 Kohane et al.
9,315,426 B2 * 4/2016 Hitchings ..... C04B 41/009
9,421,606 B2 8/2016 Propheter-Hinckley et al.
2004/0108088 A1 * 6/2004 Grassi ..... B22C 7/023 164/34
2004/0134634 A1 * 7/2004 Yang ..... B22C 9/04 164/35
2005/0092459 A1 * 5/2005 McGuire ..... B22C 1/02 164/519
2005/0178521 A1 * 8/2005 Grassi ..... B22C 7/023 164/34
2005/0258577 A1 11/2005 Holowczak et al.
2008/0135202 A1 * 6/2008 Lee ..... B22C 9/101 164/28
2008/0173421 A1 * 7/2008 Jones ..... B22C 1/165 164/361
2011/0068517 A1 * 3/2011 Maguire ..... C04B 33/32 264/610
2011/0186258 A1 * 8/2011 Bullied ..... B22D 27/08 164/65
2011/0204205 A1 * 8/2011 Kamel ..... B22C 9/103 249/184
2012/0193841 A1 8/2012 Wang et al.
2013/0026338 A1 * 1/2013 Castle ..... B22C 9/04 249/114.1
2013/0220571 A1 * 8/2013 Mueller ..... B28B 1/24 164/44
2013/0341822 A1 * 12/2013 Ellgass ..... B22C 9/103 264/219
2014/0190647 A1 * 7/2014 McGuire ..... B22C 1/02 164/15
2015/0078958 A1 * 3/2015 Bewlay ..... B22C 9/043 420/417
2015/0158076 A1 * 6/2015 Bochiechio ..... B22C 3/00 164/72
2016/0175923 A1 6/2016 Liu et al.
2016/0207100 A1 * 7/2016 Noraas ..... B22C 9/22
2018/0029106 A1 2/2018 DiFoggia et al.
2018/0178272 A1 * 6/2018 Fuccio ..... B33Y 10/00
2018/0214941 A1 * 8/2018 Castle ..... B22D 29/002

* cited by examiner

APPARATUS AND METHOD FOR INVESTMENT CASTING CORE MANUFACTURE

BACKGROUND OF THE INVENTION

1. Technical Field

This disclosure relates generally to methods and apparatus for investment casting of a metallic component, and to methods and apparatus for producing ceramic casting cores in particular.

2. Background Information

Investment casting is a well-known metal-forming process, commonly used in the aerospace and power industries to produce gas turbine components such as airfoils having complex outer surface shapes and internal cooling passage geometries.

The production of a component using a prior art investment casting process involves producing a ceramic casting vessel that includes an outer ceramic shell having an inside surface corresponding to the desired outer surface shape of the component, and one or more ceramic cores positioned within the outer ceramic shell corresponding to hollow interior passages to be formed within the component. FIG. 1 illustrates a diagrammatic example of a prior art ceramic core 10. Molten metal alloy is introduced into the ceramic casting vessel and is then allowed to cool and to solidify. The outer ceramic shell and ceramic core(s) are then removed by mechanical or chemical means to reveal the cast component having the desired external shape and hollow interior volume(s) in the shape of the ceramic core(s).

There are challenges, limitations, and disadvantages associated with the prior art investment casting processes. This is particularly true with respect to producing the ceramic cores used to produce the internal voids of the cast component; e.g., the cooling passages within a hollow airfoil. Some prior art methods involve require a first step of creating a metallic mold that is used to form the ceramic core. Metallic molds can be very difficult and expensive to produce, particularly those associated with intricate internal geometries. In addition, although metallic molds can be used to produce a number of ceramic cores, such molds do have a limited useful life. The ceramic core is formed by injecting a ceramic material into the metallic mold and allowing the ceramic material to solidify into a "green" core. The green core is subsequently covered in a bed of loose sand and subjected to a thermal process (i.e., "fired") until the "green" core is transformed to a "sintered" core. Both the green core and the sintered core are brittle structures that are easily damaged. This is particularly true when the core has very fine details.

The interior cavity geometry of a hollow airfoil is often limited by manufacturing processes; e.g., if a ceramic core cannot be made with a particular geometry, then an airfoil having an internal cavity with that geometry cannot be made by an investment casting process. For example, in those instances wherein a metallic die is used to form the ceramic core, including the exterior surface geometry of the ceramic core, the ceramic core must be removable from the metallic die; i.e., the operator must be able to "pull" the green ceramic core from the die along "pull planes", which pull planes can limit the possible exterior core surface (and therefore the interior cavity wall configuration) geometries.

Indeed, the ability to manufacture an interior cavity is-often a limiting factor in hollow airfoil design.

What is needed is an improved method of manufacturing hollow components, including improved methods for manufacturing interior ceramic cores, one that is capable of producing a greater number of interior core geometries, and one that is cost effective.

SUMMARY

According to an aspect of the present disclosure, a method of producing an investment casting ceramic core is provided. The method includes: providing a core body consisting of a leachable material; surrounding the core body with a mold composition within a vessel, which mold composition is configured to solidify; leaching the core body from the mold composition subsequent to the mold composition solidifying, thereby leaving an internal cavity within the solidified mold composition; depositing a ceramic composition within the internal cavity of the solidified mold composition; sintering the ceramic composition to a solid ceramic core; and removing the solid ceramic core from the mold composition.

According to an aspect of the present disclosure, a ceramic core mold composition is provided. The composition includes one or more body constituents that include at least one refractory material in particulate form, and one or more solidifying constituents configured to solidify the mold composition in a dimensionally stable form around a core body consisting of a leachable material. The solidified mold composition is configured to remain in a solid form, including an internal cavity subsequent to leaching of the core body. The solidified mold composition is configured to transform from the solid state to a non-solid form during a sintering process.

According to an aspect of the present disclosure, a method of producing an investment casting ceramic core is provided. The method includes: surrounding a core body with a mold composition within a vessel, which mold composition is configured to solidify around the core body; leaching the core body from the mold composition subsequent to the mold composition solidifying, thereby leaving an internal cavity within the solidified mold composition; depositing a ceramic composition within the internal cavity of the solidified mold composition; sintering the ceramic composition to a solid ceramic core; and removing the solid ceramic core from the mold composition.

In any of the aspects and embodiments of the present disclosure, the mold composition may transform from a solidified mold composition to a non-solid form during a sintering process.

In any of the aspects and embodiments of the present disclosure, the mold composition may transform from the solidified mold composition to a loose particulate form during sintering.

In any of the aspects and embodiments of the present disclosure, the mold composition may include one or more body constituents and one or more solidifying constituents.

In any of the aspects and embodiments of the present disclosure, the one or more body constituents may include at least one refractory material in particulate form.

In any of the aspects and embodiments of the present disclosure, the one or more body constituents may include one or more of alumina, crystalline silica, or magnesia particulates.

In any of the aspects and embodiments of the present disclosure, the one or more solidifying constituents may include a binder configured to bind the at least one refractory material in particulate form into a solid.

In any of the aspects and embodiments of the present disclosure, the binder may include at least one of a polyvinyl alcohol, a sodium silicate, a polyethylene glycol, an aqueous solution of starch, or a poly-acrylate.

In any of the aspects and embodiments of the present disclosure, during a sintering step the mold composition may change to a form that permits the sintered ceramic composition to be removed undamaged from the vessel.

In any of the aspects and embodiments of the present disclosure, during a sintering step the ceramic composition may be configured to cause the one or more solidifying constituents to depart from the vessel and remaining mold composition constituents within the vessel in a loose particle form.

In any of the aspects and embodiments of the present disclosure, the one or more solidifying constituents are configured to depart from the mold composition during a sintering process.

DETAILED DESCRIPTION

Figure 1:
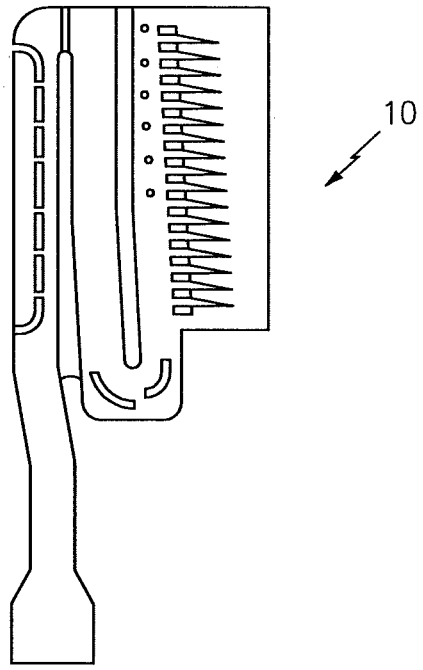
FIG. 1 (PRIOR ART)
FIG. 1 is a diagrammatic planar view of a prior art ceramic core.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Figure 2:
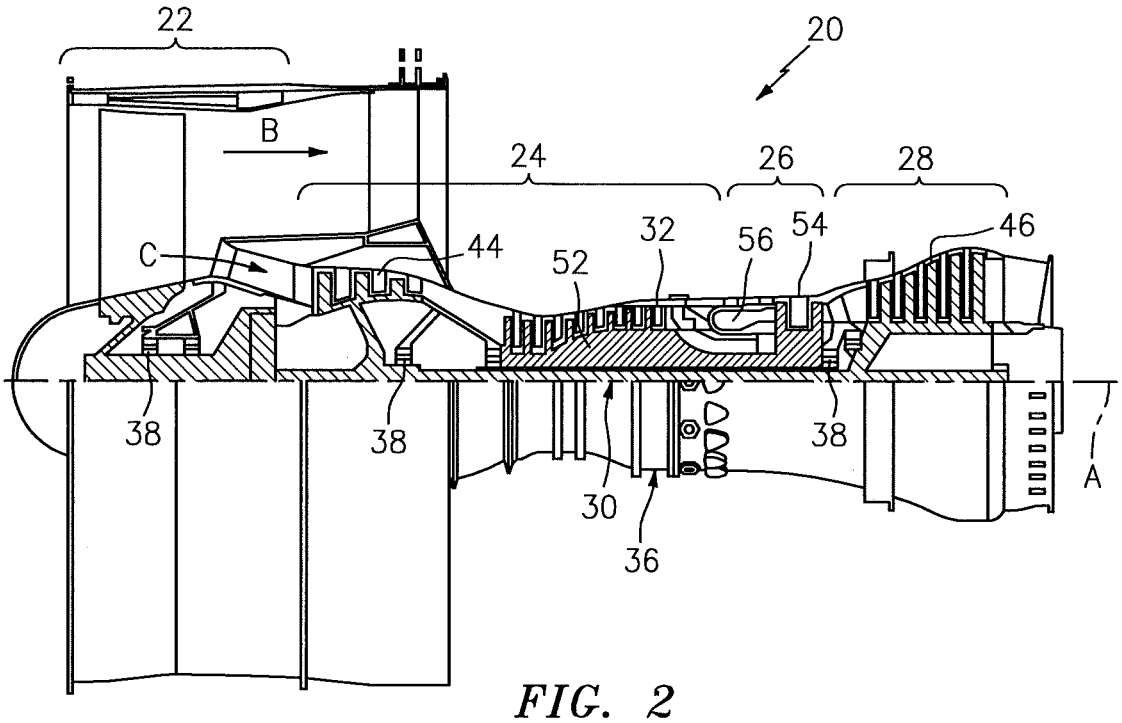
FIG. 2 is a diagrammatic cross-sectional view of a portion of a gas turbine engine.

Referring now to the FIGURES, to facilitate the description of the present disclosure a two-spool turbofan type gas turbine engine 20 is shown (e.g., see FIG. 2). This exemplary embodiment of a gas turbine engine includes a fan section 22, a compressor section 24, a combustor section 26, and a turbine section 28. The fan section 22 drives air along a bypass flow path B in a bypass duct, while the compressor section 24 drives air along a core flow path C for compression and communication into the combustor section 26 then expansion through the turbine section 28.

The exemplary engine 20 shown in FIG. 1 includes a low speed spool 30 and a high speed spool 32 mounted for rotation about an engine central longitudinal axis A relative to an engine static structure 36. The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion.

Core airflow increases in temperature as it travels through the engine. A variety of components that are exposed to high temperature air are often cooled by lower temperature air (e.g., bypass air flow) passing through cooling passages or ducts formed within or between components. Many of these "cooled" components are produced by using a casting process, and include interior cavities for receiving cooling air. To facilitate the description of the present disclosure provided below, the present disclosure will be described in terms of producing a ceramic core for a hollow airfoil such as a turbine blade or stator. The present disclosure is not, however, limited to these particular applications, however, and can be used in the manufacture of a variety of different components.

Figure 3:
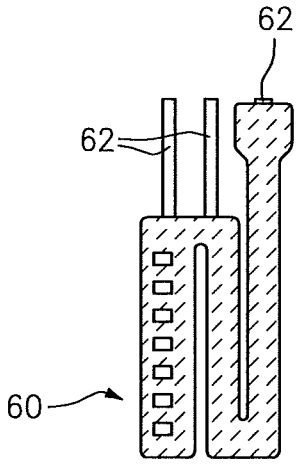
FIG. 3 is a diagrammatic view of a core body.

The present disclosure includes forming a core body 60 (e.g., see FIG. 3) having a geometry that corresponds to the interior cavity geometry of the airfoil; i.e., the core body 60 is the positive of the airfoil interior cavity. The core body 60 is made from a material that is operable to be shaped in the desired form and can be subsequently leached from a mold as will be described below. The term "leach" as used herein means that the process for transforming a solid core body material to an alternative form (e.g., a liquid, a slurry, a gas, etc.) that can be removed from the mold without damage to the mold. As an example, a material that can be formed as a solid and can be dissolved into liquid solution that is inert with respect to the mold, or that can be vaporized, or thermally melted, etc., would be a viable material candidate. A specific non-limiting example of a core body material is a soluble wax.

The core body 60 itself can be formed by a variety of techniques, and is therefore not limited to any particular formation technique. For example, the core body 60 can be formed by injecting the core body material into a die, or extruding the core body material through a die. In some instances, the core body 60 may be formed using a three-dimensional printing process. In some instances, the core body 60 may be formed using a machining process; e.g., where core body material is removed from an initial body with the remaining material assuming the desired core body 60 geometry. To be clear, the present disclosure is not limited to any particular core body 60 formation technique. Combinations of core body 60 formation techniques may be used to arrive at the desired core body 60 geometry. The particular geometry of the core body 60 may dictate which core body 60 formation technique(s) is best suited for use in core body formation.

In some applications, the core body 60 may initially include more than one core body component and those components may be subsequently joined together to form the final core body 60 geometry. The ability of the present disclosure to form and utilize a three-dimensional core body 60 (e.g., having core body components that connected to one another to form, for example, interior walls and cavities) increases the number of different core body geometries (and three-dimensional complexities) that can be produced. As a result, the ability to create a component such as an airfoil with improved internal geometries, and concomitant improved structural and/or cooling characteristics is greatly enhanced.

In some embodiments, one or more structures 62 may be attached to core body 60 for the purpose of establishing a material access channel to the core body 60. These access channels are sometimes referred to as "sprues" or "ingates" (to facilitate the description, we refer to these channels generically hereinafter as "sprues"). Each sprue 62 provides a passage through which the core body material can be removed from a mold, and through which a ceramic composition 66 can subsequently be injected into the void formed in the mold by the removal of the core body material. The geometry and configuration of the sprue(s) 62 are typically dictated by the geometry and configuration of the core body 60; i.e., the sprue(s) 62 are selected to ensure that all of the core body material can be removed from the mold and a sufficient amount of ceramic material can be subsequently injected into the mold to fill the aforesaid void. Because sprues, ingates, and their respective uses are well-known, no further discussion is required herein. In some applications, however, the geometry of the core body 60 may be such that no sprue 62 is required; e.g., the core body 60 may include a feature that can function as a sprue 62. Hence, there is no requirement that one or more sprues be included.

Figure 4:
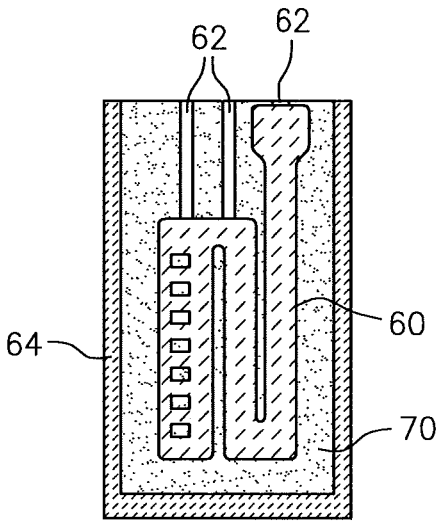
FIG. 4 is a diagrammatic view of a core body disposed within a vessel surrounded by mold composition.

Now referring to FIG. 4, the solid core body 60 is placed in a vessel 64, separated a distance from the walls of the vessel 64. The vessel 64 may be configured (e.g., a ceramic boat, etc.) for later use when firing a ceramic composition 66 that will form a final sintered ceramic core 68, or the vessel 64 may be configured otherwise; e.g., a vessel that may be disposed of once the mold is created.

Once the core body 60 is positioned within the vessel 64, a mold composition 70 is poured into the vessel 64 and completely surrounds the core body 60. In those applications wherein one or more sprues 62 that may be attached to core body 60, an end of the sprue(s) 62 may be exposed relative to the mold composition 70. The mold composition 70 typically, but not necessarily, includes one or more body constituents in powder or granular form and one or more constituents that are operable to cause the mold composition 70 to assume a solid form (referred to hereinafter as "solidifying constituents"). The body constituent(s) has a temperature resistance great enough to remain unchanged (e.g., dimensionally stable) at temperatures necessary to fire a ceramic material from a green state to a sintered state as will be described below. Non-limiting examples of acceptable types of body constituents include refractory materials such as alumina, crystalline silica (e.g., quartz, cristobalite, etc.), and magnesia in particle form (typically loose particle form). The size of the refractory material particles can vary depending on the particular application, but in most applications a particle size in the range of about five to five-hundred micrometers (~5-500 μm) is acceptable.

The one or more constituents operable to cause the mold composition 70 to assume a solid form (i.e., the "solidifying constituent(s)") may vary depending upon the particular body constituent(s) used, but in most instances where the body constituent is a refractory material, a "binder" may be used to cause the mold composition 70 to assume a solid form. The term "binder" as used herein refers to a composition that is operable to bind the body constituent particles collectively together under certain conditions. The solidifying constituent(s) may be configured such that when the solid mold composition 70 is subjected to a temperature adequate to fire a ceramic material from a green state to a sintered state, the solidifying constituent either departs from the mold composition 70 or changes form, leaving the remaining mold composition constituents in a form (e.g., a loose particulate form) that permits the sintered ceramic composition (i.e., the "sintered ceramic core 68") to be removed undamaged from the vessel 64 containing the sintered ceramic core 68 and the remaining mold composition 70. The solidifying constituent(s) may be also be configured such that when the solid mold composition 70 is subjected to a temperature adequate to fire a ceramic material from a green state to a sintered state, the departure (or alteration) of the solidifying constituent will not alter the geometry assumed by the remaining mold composition constituents. As an example, in those embodiments that utilize a binding agent as a solidifying constituent in combination with a particulate refractory material, the amount of binder would be great enough to accomplish the aforesaid binding, but low enough to such that it departure would not compromise the mold. Non-limiting examples of a binder that can be used to solidify refractory materials include poly-vinyl alcohol, sodium silicate, polyethylene glycol, aqueous solutions of starch, and poly-acrylates. The refractory materials and the solidifying constituent(s) are inert with respect to the material used to form the core body 60.

In some instances once the mold composition 70 is deposited within the vessel 64, the mold composition 70 may be subjected to a low pressure environment (e.g., a vacuum) to facilitate the removal of any air that may be entrained within the mold composition 70.

The manner in which the mold composition 70 solidifies will depend on the constituents within the mold composition 70. For example, in those mold compositions 70 that include one or more refractory materials and one or more binders, the binder will bind the refractory particles into a solid body. The reaction may take place in an ambient environment (e.g., ambient temperature, pressure, and air). Alternatively, the reaction may take place in an environment having a particular gas environment, and/or at a pressure or temperature other than ambient.

Figure 5:
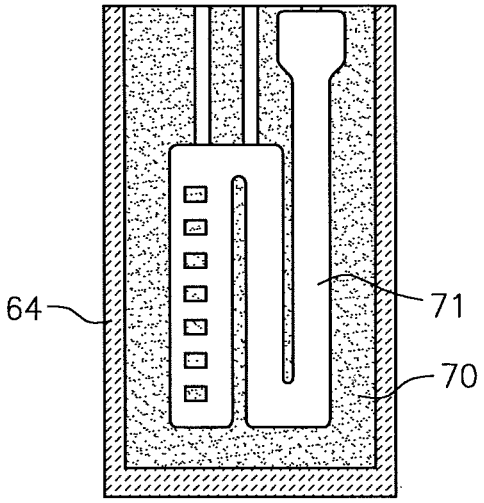
FIG. 5 is a diagrammatic view of a solidified mold composition with the core body removed, leaving a void within the solidified mold composition.

Now referring to FIG. 5, once the mold composition 70 is adequately solidified, the core body 60 may be leached from the solidified mold composition 70. The specific process by which the core body 60 is leached from the solidified mold composition 70 will depend on the core body material. A wax core body material, for example, may be leached by subjecting the mold composition 70 and core body 60 to an elevated temperature at or above the melting temperature of the wax. In those embodiments having one or more sprues 62, the liquefied wax may be poured from the solidified mold composition 70. As indicated herein, the conditions required to effectuate the leaching should be selected to avoid causing the solidified mold composition 70 to change from its solid form.

Figure 6:
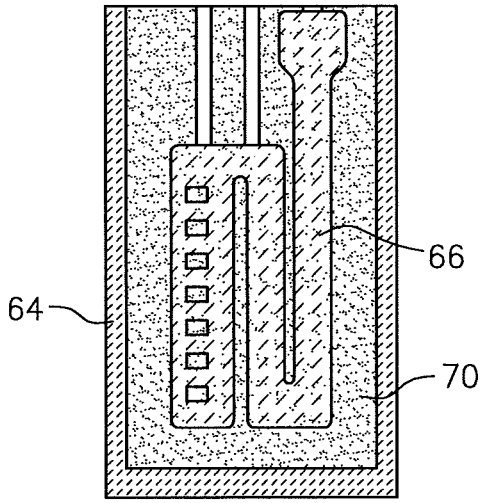
FIG. 6 is a diagrammatic view of a green ceramic composition disposed within the void in the solidified mold composition left by the removed core body.

Now referring to FIG. 6, once the core body 60 is leached from the solidified mold composition 70, the solidified mold composition 70 includes an internal cavity 71 (which may be referred to as a "void") previously occupied by the core body 60, and the solidified mold composition 70 is in a form to operate as a mold. As indicated above, the vessel 64 used to contain the mold composition 70 during solidification may or may not be used to hold the solidified mold composition 70 for subsequent steps; e.g., ceramic core solidification. If the aforesaid vessel 64 used during mold composition solidification is not used during subsequent steps, the solidified mold composition 70 may be transferred to a second vessel (e.g., a ceramic boat, etc.) that is acceptable for subsequent steps. A ceramic composition 66 can be injected or otherwise deposited into the void 71 formed in the solidified mold composition 70 by the removal of the core body material; e.g., through the sprue(s) 62. The present disclosure is not limited to use with any particular ceramic composition 66. Ceramic compositions 66 useful for the formation of a casting core are well known in the art, and further description is not required. In some instances once the ceramic composition 66 is deposited within the vessel 64, it may be subjected to a low pressure environment (e.g., a vacuum) to facilitate the removal of any air that may be entrained within the ceramic composition 66.

Figure 7:
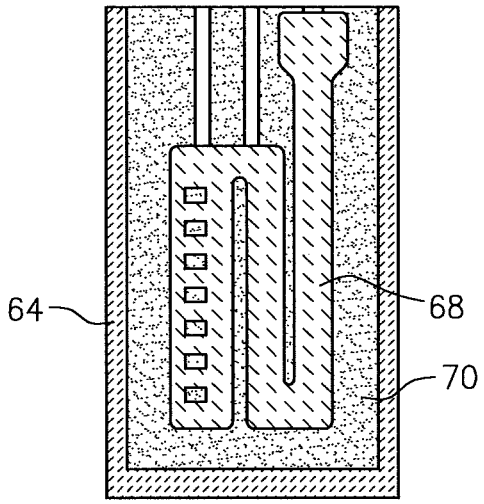
FIG. 7 is a diagrammatic view of a sintered ceramic core disposed within a vessel surrounded by loose mold composition material.
Figure 8:
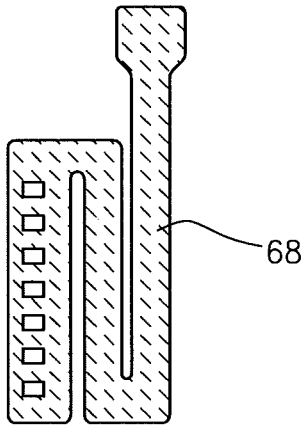
FIG. 8 is a diagrammatic view of a sintered ceramic core.
Figure 9:
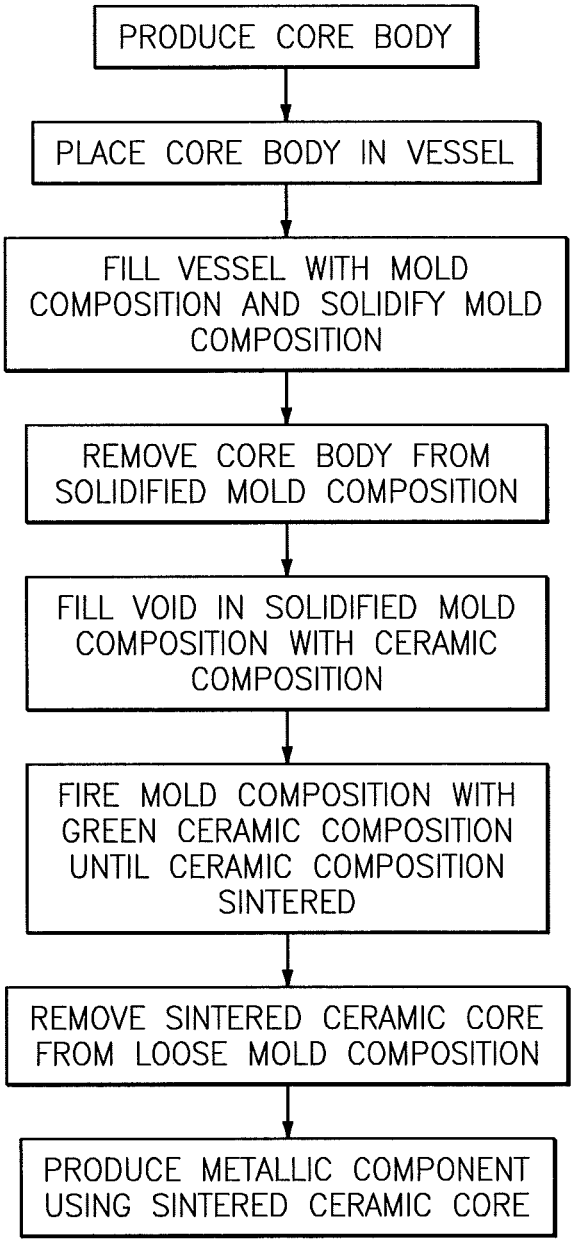
FIG. 9 is a flow diagram of an embodiment of the present disclosure.

Now referring to FIGS. 7 and 8, the solidified mold composition 70 containing the ceramic composition 66 is now subjected to a process adequate to cause the ceramic composition 66 to become a sintered ceramic core 68. The specific sintering process may depend on the characteristics of the ceramic composition 66. The present disclosure is not limited to use with any particular ceramic composition 66. Processes useful for sintering ceramic compositions are well known in the art, and further description is not required. As indicated above, in some embodiments the solidifying constituent(s) is configured such that when the ceramic composition 66 is sintered, the solidifying constituent either departs from the mold composition 70 or changes form, leaving the remaining mold composition constituents in a form (e.g., a loose particle form) that permits the sintered ceramic core 68 to be removed undamaged from the vessel 64 containing the sintered ceramic core 68 and the remaining mold composition 70.

The sintered core 68 formed from the ceramic composition 66 can subsequently be removed from the no longer solidified mold composition 70, and utilized to create a component such as an airfoil with a hollow interior cavity. Methods for creating a component such as an airfoil with a hollow interior cavity using a ceramic core are known in the art, and further description is not required here. The present disclosure is not limited to any such process.

The significance of the present disclosure wherein a non-solid composition mold can be provided around a core body 60 should be noted. As indicated above, prior art investment casting processes often require a metallic die (sometimes referred to as a "mold") be produced to form the ceramic core, including the exterior surface of the ceramic core, which exterior surface provides the basis for the interior cavity surface of the object (e.g., a hollow airfoil) being produced. A person of skill in the art will recognize that such metallic dies can be very difficult and expensive to produce, and often have a limited useful life. Also as indicated above, the interior cavity geometry of an object such as a hollow airfoil is often limited by such metallic dies; e.g., the ceramic core must be removable from the metallic core along "pull planes". The present disclosure utilizes a mold composition 70 that can form intricate ceramic core surfaces (which in turn can form intricate object surfaces) and is subsequently removable as a loose particulate. Hence, the need for an expensive metallic die is avoided. Furthermore, the present disclosure has no die "pull-plane" limitation. As a result, it is possible to form objects (e.g., hollow airfoils) with configurations not possible using a ceramic core formed within a metallic die.

While various embodiments of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

The invention claimed is:

1. A method of producing an investment casting ceramic core, comprising:

providing a core body consisting of a leachable material;

placing the core body inside and separated a distance from a vessel thereby defining a space between the core body and the vessel;

surrounding the core body with a mold composition within the vessel by pouring the mold composition into the vessel so as to fill the space between the core body and the vessel, which mold composition is configured to solidify;

leaching the core body from the mold composition subsequent to the mold composition solidifying, thereby leaving an internal cavity within the solidified mold composition;

depositing a ceramic composition within the internal cavity of the solidified mold composition;

sintering the ceramic composition to a solid ceramic core; and removing the solid ceramic core from the mold composition, wherein the mold composition transforms from the solidified mold composition to a loose particulate form during the sintering.

2. The method of claim 1, further comprising subjecting the mold composition to a vacuum pressure environment subsequent to surrounding the core body with the mold composition.

3. The method of claim 1, wherein the mold composition includes one or more body constituents and one or more solidifying constituents.

4. The method of claim 3, wherein the one or more body constituents include at least one refractory material in particulate form.

5. The method of claim 4, wherein the one or more body constituents include one or more of alumina, crystalline silica, or magnesia particulates.

6. The method of claim 4, wherein the one or more solidifying constituents includes a binder configured to bind the at least one refractory material in particulate form into a solid.

7. The method of claim 6, wherein the binder includes at least one of a poly-vinyl alcohol, a sodium silicate, a polyethylene glycol, an aqueous solution of starch, or a poly-acrylate.

8. The method of claim 6, wherein the loose particulate form permits the sintered ceramic composition to be removed undamaged from the vessel.

9. The method of claim 6, wherein the step of sintering the ceramic composition is configured to cause the one or more solidifying constituents to depart from the vessel leaving remaining mold composition constituents within the vessel in the loose particulate form.

10. A method of producing an investment casting ceramic core, comprising:

placing the core body inside and separated a distance from a vessel thereby defining a space between the core body and the vessel;

surrounding the core body with a mold composition within the vessel by pouring the mold composition into the vessel so as to fill the space between the core body and the vessel, which mold composition is configured to solidify around the core body;

leaching the core body from the mold composition subsequent to the mold composition solidifying, thereby leaving an internal cavity within the solidified mold composition;

depositing a ceramic composition within the internal cavity of the solidified mold composition;

sintering the ceramic composition to a solid ceramic core; and removing the solid ceramic core from the mold composition, wherein the mold composition transforms from the solidified mold composition to a loose particulate form during the sintering.

11. The method of claim 10, wherein the mold composition includes one or more body constituents and one or more solidifying constituents;

wherein the one or more body constituents include at least one refractory material in particulate form; and wherein the one or more solidifying constituents includes a binder configured to bind the at least one refractory material in particulate form into a solid.

12. The method of claim 11, wherein the one or more body constituents include one or more of alumina, crystalline silica, or magnesia particulates.

13. The method of claim 11, wherein the binder includes at least one of a poly-vinyl alcohol, a sodium silicate, a polyethylene glycol, an aqueous solution of starch, or a poly-acrylate.

14. The method of claim 10, further comprising subjecting the mold composition to a vacuum pressure environment subsequent to surrounding the core body with the mold composition.

* * * * *